US008245555B2

(12) United States Patent
Pesch et al.

(10) Patent No.: US 8,245,555 B2
(45) Date of Patent: Aug. 21, 2012

(54) HEADREST FRAME AND METHOD

(75) Inventors: William A. Pesch, West Olive, MI (US); Ronald L. Dean, Grandville, MI (US); Mark R. Landman, Holland, MI (US); Brent E. Heeres, Zeeland, MI (US); Matthew S. Harmsen, Zeeland, MI (US)

(73) Assignee: Innotec Corporation, Zeeland, MI (US)

( * ) Notice: Subject to any disclaimer, the term of this patent is extended or adjusted under 35 U.S.C. 154(b) by 657 days.

(21) Appl. No.: 12/409,202

(22) Filed: Mar. 23, 2009

(65) Prior Publication Data

US 2009/0235711 A1 Sep. 24, 2009

Related U.S. Application Data

(60) Provisional application No. 61/038,490, filed on Mar. 21, 2008.

(51) Int. Cl.
*B21D 17/04* (2006.01)
*B21D 7/022* (2006.01)

(52) U.S. Cl. ..... 72/370.21; 72/214; 72/452.6

(58) Field of Classification Search ..... 72/370.21, 72/74, 112, 120–123, 190, 195, 452.1, 52.4, 72/452.6, 214–216
See application file for complete search history.

(56) References Cited

U.S. PATENT DOCUMENTS

| | | | | |
|---|---|---|---|---|
| 5,467,627 | A | 11/1995 | Smith et al. | |
| 5,722,281 | A | 3/1998 | Yasuda et al. | |
| 6,000,287 | A | 12/1999 | Menzel | |
| 6,170,313 | B1 | 1/2001 | Vasseur et al. | |
| 6,748,780 | B1 * | 6/2004 | Luttgeharm | 72/115 |
| 7,267,407 | B1 | 9/2007 | Demick et al. | |
| 2002/0060489 | A1 | 5/2002 | Richard | |
| 2005/0016248 | A1 | 1/2005 | Ishikawa et al. | |
| 2005/0034499 | A1 | 2/2005 | Matsumoto | |
| 2005/0039512 | A1 | 2/2005 | Lefevere | |

FOREIGN PATENT DOCUMENTS

| | | |
|---|---|---|
| JP | 2007-203873 | 8/2007 |
| KR | 1998-030510 | 8/1998 |

OTHER PUBLICATIONS

International Search Report, International Application No. EP09722566, filed Aug. 26, 2011. (4 pages).

* cited by examiner

*Primary Examiner* — Debra Sullivan
(74) *Attorney, Agent, or Firm* — Price Heneveld LLP

(57) ABSTRACT

A device and method for forming notches in tubes or other parts includes a roller that travels along a non-linear path. The roller may include a component of motion away from the part to reduce bulging or other deformations in an outer surface of the part that could otherwise result from a straight roller path.

36 Claims, 10 Drawing Sheets

HEADREST FRAME AND METHOD

CROSS REFERENCE TO RELATED APPLICATION

This application claims the benefit of U.S. Provisional Application No. 61/038,490, filed on Mar. 21, 2008, entitled HEADREST FRAME AND METHOD, the entire contents of which are incorporated herein by reference.

BACKGROUND OF THE INVENTION

Tubular members may be utilized to support headrests, armrests, or other components of a vehicle seat, and such tubes may include notches that are engaged by a device to prevent or otherwise control movement of the headrest or other seat component relative to the other seat components. Various machines and methods have been developed for forming notches in metal bars and tubes used in this and other applications. However, known tooling and processes for forming notches may suffer from various drawbacks.

DETAILED DESCRIPTION OF PREFERRED EMBODIMENT

Figure 1:
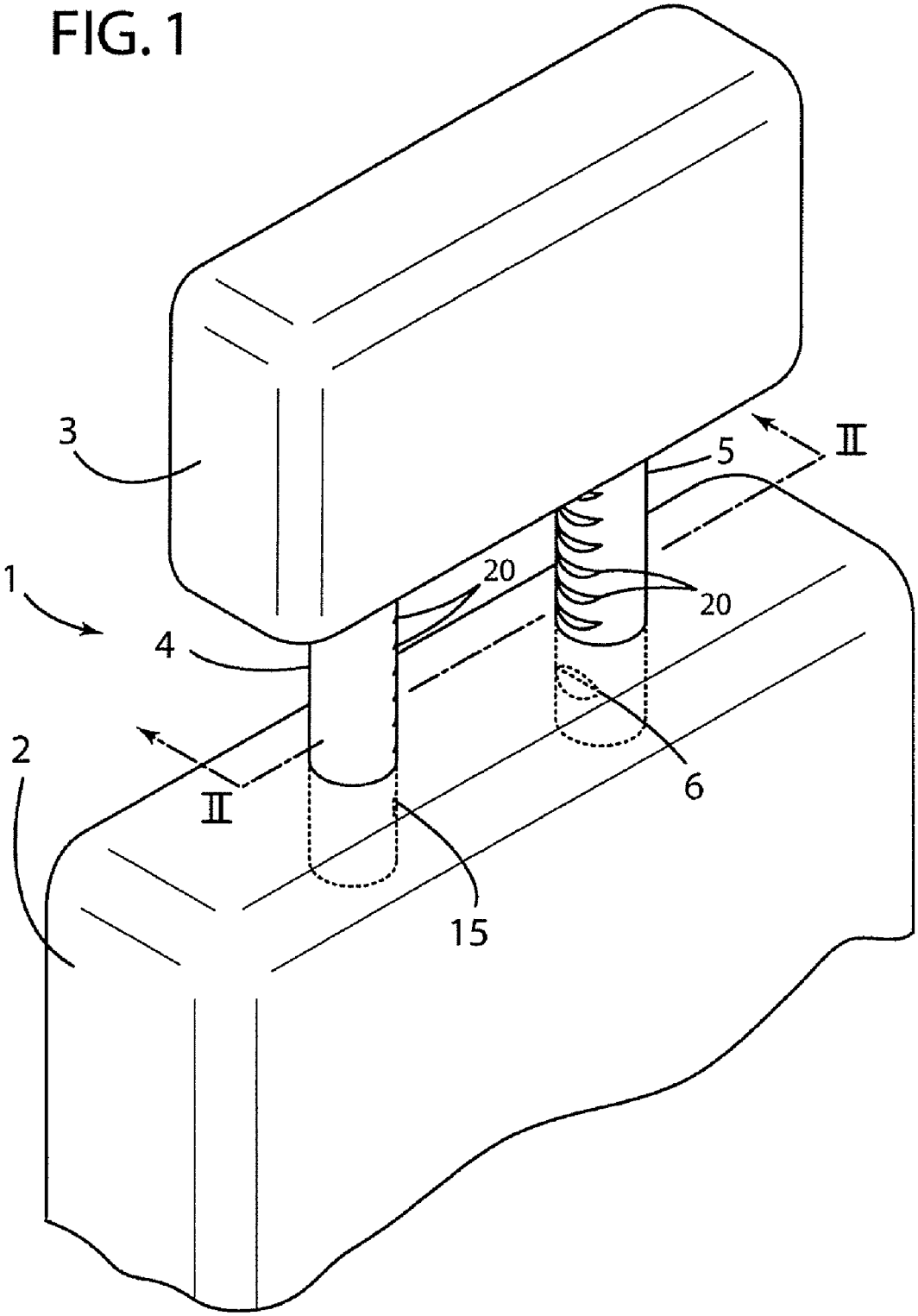
FIG. 1 is a partially fragmentary isometric view of a vehicle seat and headrest including notched tubular members supporting the headrest.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

A vehicle seat 1 includes seat back 2, a headrest 3, and tubular supports 4 and 5. A plurality of notches 6 in the tubular supports 4 and 5 provide for height adjustment of the headrest 3 relative to the seatback 2 via a device 7 (see also FIG. 2) that engages the notches 6. In general, the device 7 permits the headrest 3 to be moved vertically and selectively retains the headrest 3 at a desired vertical position. Various devices have been developed for engaging the notches 6, such that the device 7 will not be described in detail herein.

Referring again to FIG. 2, the tubes 4 and 5 have a sidewall having a thickness "T" as required for a particular application. In the illustrated example, the tubes 4 and 5 are made of steel or other metal material having the desired strength and other engineering properties. However, other deformable materials may also be utilized for the tubes 4 and 5. Tubes 4 and 5 typically have an outside diameter of about 10-14 mm, and a wall thickness in the range of about 0.75 mm to about 2.60 mm. However, it will be understood that tubes for other applications such as shelving racks, etc. may be formed according to the present invention, and the tubes utilized for such applications may have diameters and wall thicknesses that are much larger or smaller than the typical ranges noted above. Also, according to another aspect of the present invention, notches may be formed in tubes having oval, square, or other non-circular cross sectional shapes. Still further, according to yet another aspect of the present invention, the tubing could have a non-uniform wall thickness, or the material being formed could comprise a solid bar or the like rather than a tube.

Figure 2:
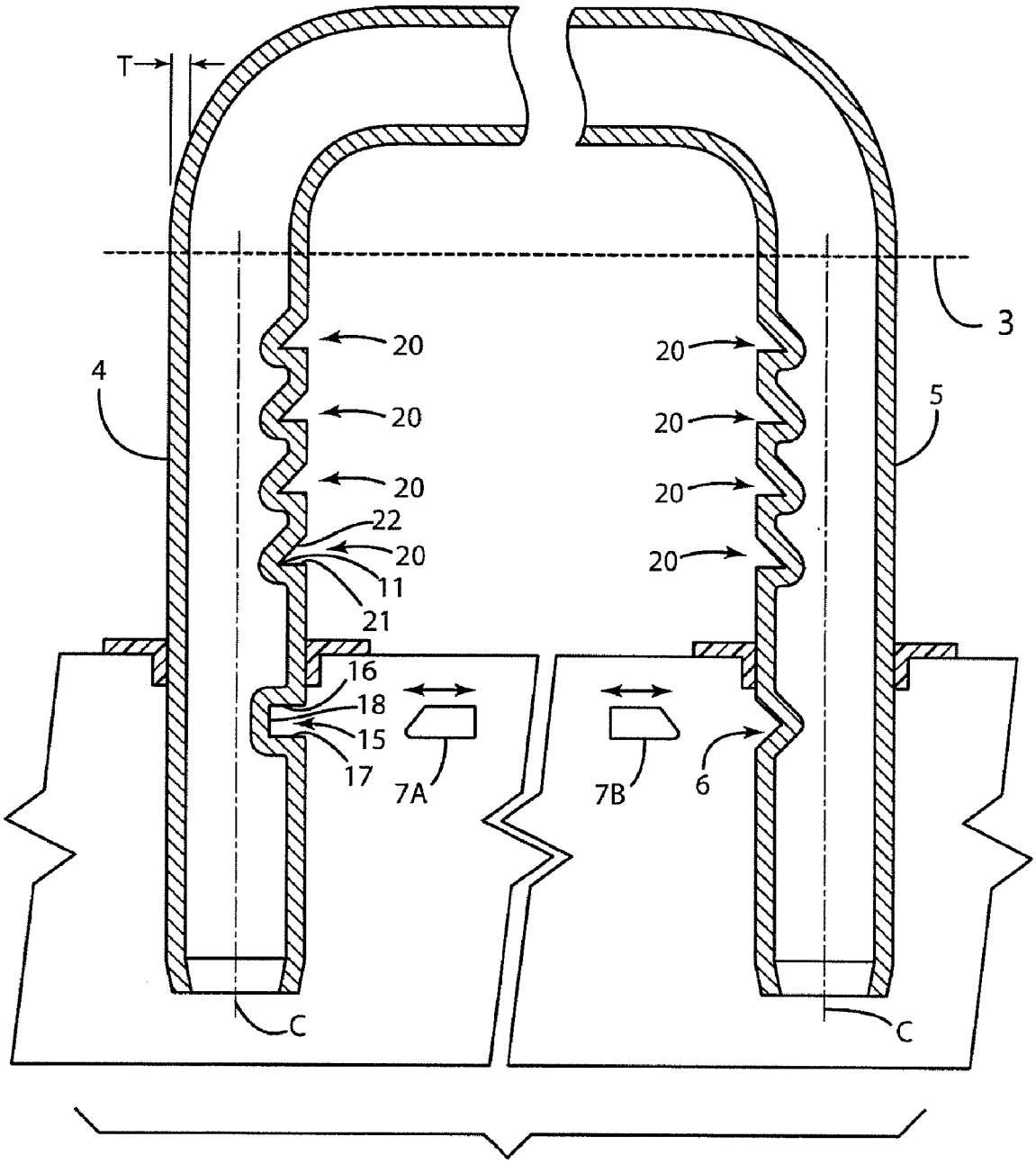
FIG. 2 is a cross-sectional view of notched tube members engaging a seat structure according to one aspect of the present invention.
Figure 18:
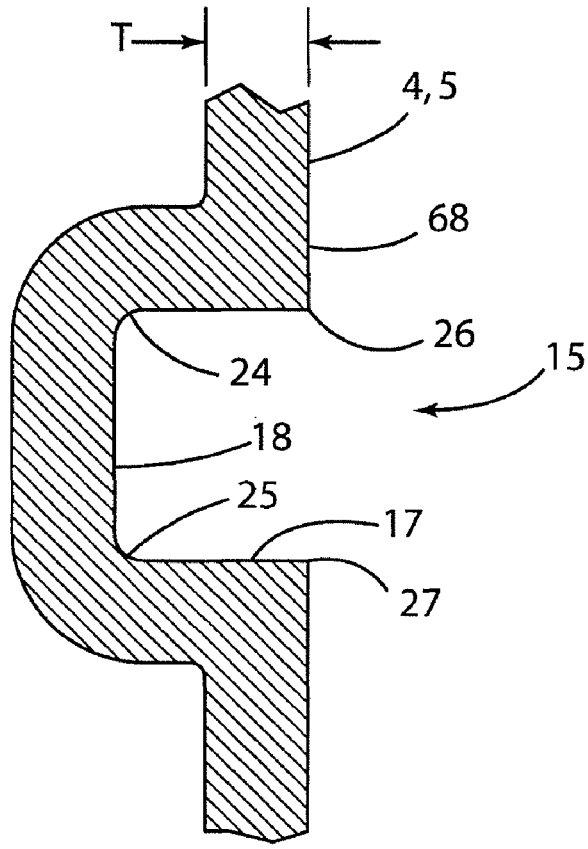
FIG. 18 is a partially fragmentary cross sectional view of a two-way locking notch.
Figure 19:
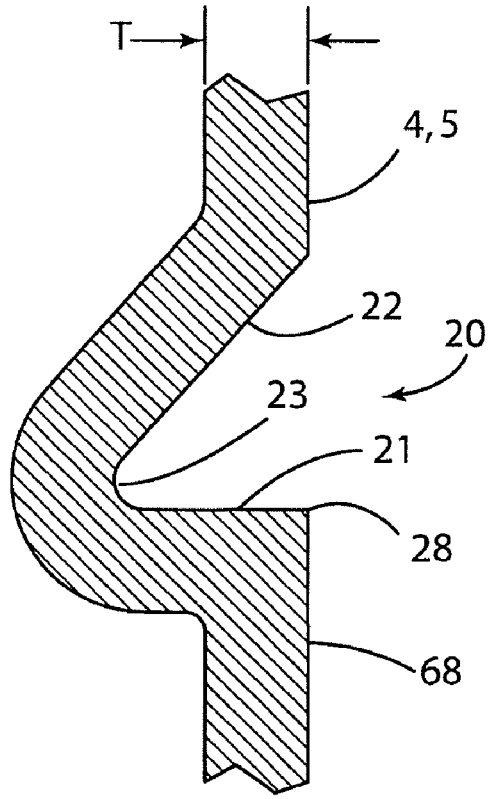
FIG. 19 is a partially fragmentary cross section view of a one-way locking notch.

In the example illustrated in FIG. 2, the tubes 4 and 5 may include one or more detent-forming of grooves or V-shaped notches 6, one or more U-shaped two-way locking notches 15 (see also FIG. 18), and one or more one-way locking notches 20 (see also FIG. 19). In the illustrated example, tubes 4 and 5 include a plurality of one-way notches 20. Tube 4 includes a single U-shaped two-way locking notch 15, and tube 5 includes a single V-shaped detent notch 6. The notches 6 are substantially V-shaped, with generally flat surfaces that intersect to form a root portion 11. Root 11 may be sharp, or it may have a radius, depending upon the requirements for a particular application. Notch 15 is substantially U-shaped, with generally parallel sidewalls 16 and 17 and a smoothly radiused base surface 18. The one-way locking groove or notch 20 has a first surface 21 that is generally transverse or perpendicular to the center line "C" of the tubes 4 and 5. The notch 20 also includes an angled surface 22 that extends at an acute angle relative to the center line C of tubes 4 and 5. The machine and method described in more detail below may be utilized to form notches or grooves having various shapes and sizes, with flat and/or curved surfaces. It will be understood that the various notches shown in FIG. 2 are examples of notches that may be formed according to the present invention, but a wide range of notch sizes and shapes may be formed according to other aspects of the present invention.

Notch 15 comprises a locking notch that is engaged by a first device 7A to prevent vertical movement of tube 4 when headrest 3 is in the uppermost position unless the device 7A is manually disengaged by a user. A second device 7B engages V-notch 6 to provide a detent when first device 7A is locked in notch 15. Notches 20 provide a one-way locking function that prevents movement of the headrest 3 in a first direction (e.g. downwardly) unless devices 7A and 7B are manually disengaged by a user, but permits movement of headrest 3 in the opposite direction (e.g. upwardly) regardless of whether or not devices 7A and 7B are manually disengaged. Because various shapes and sizes for notches 6, 15, and 20 are known in the art, the notches 6, 15, and 20 will not be described in further detail herein. Also, a variety of devices 7A, 7B are known, and the specific shape, size, and location of the notches 6, 15, and/or 20 may be configured to be compatible with a specific device 7. The tubes 4 and 5 may include only V-shaped notches 6, only U-shaped notches 15, or only one-way locking notches 20. Alternately, the tubes 4 and 5 may include a combination of notches 6, 15, and/or 20, depending on the requirements for a particular application.

Figure 3:
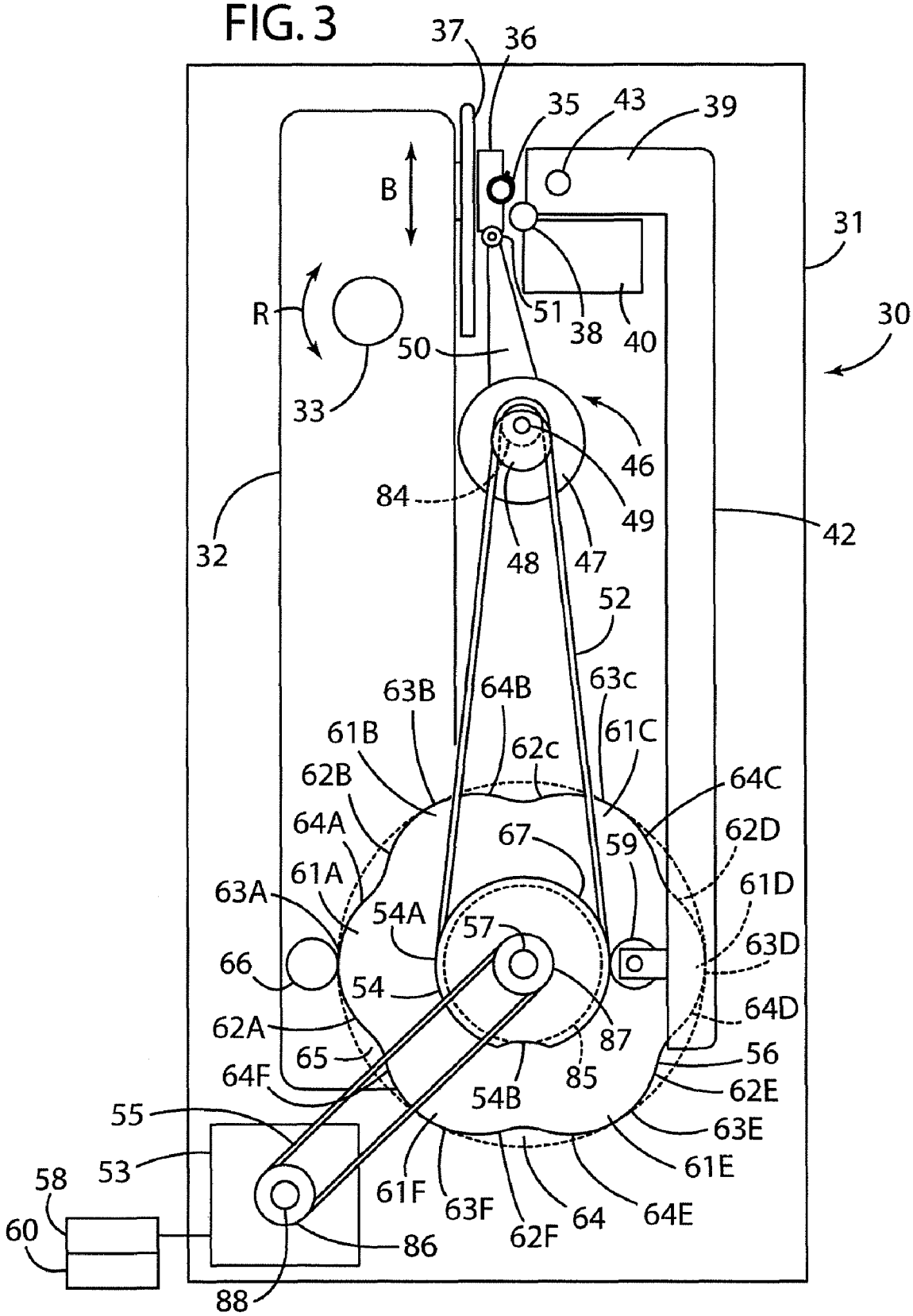
FIG. 3 is a partially schematic view of a machine utilized to form notches in a tube or the like according to one aspect of the present invention.

With further reference to FIG. 3, a machine or device 30 for forming the notches 6, 15, and/or 20 includes a support structure 31, and a first component 32 that is pivotably mounted to the support structure 31 at a shaft or pivot 33 utilizing bearings or other suitable structure and pivots relative to the support structure 31 as indicated by the arrow "R". Support structure 31 may comprise one or more plates, tubes or other suitable structure. A forming member such as roller 35 is rotatably mounted to a plate or other suitable structure 36. Forming member or roller 35 may be made from hardened tool steel, ceramic, or other suitable wear-resistant material.

The size and shape of roller 35 is selected to provide the desired notch shape, and the outer peripheral portion 29 (FIG. 4) of roller 35 has a cross-sectional surface contour corresponding to the shape of a notch formed by the roller 35. For example, outer portion 29 of roller 35 may have a symmetrical V-shape to form a notch 6 (FIG. 2), a U-shape to form a two-way locking notch 15 (see also FIG. 18), or it may have a non-symmetrical V-shape to form a one-way locking notch 20 (see also FIG. 19). The diameter of roller 35 may vary depending upon the requirements of a particular application. In general, roller 35 typically has an outer diameter that is about the same as the outer diameter of the tube being formed, or somewhat larger than the outer diameter of the tube being formed. However, the roller 35 could have a diameter that is smaller than the diameter of the tube.

Referring again to FIG. 3, the plate 36 is mounted to the first component 32 by a linear guide 37, such that roller 35 and plate 36 are constrained to move in a linear path indicated by the arrow "B" relative to the first component 32. Linear guide 37 may comprise one or more commercially available assemblies having one or more rods, tracks, or the like, with linear bearings that engage the rods or tracks. An eccentric assembly 46 provides for powered reciprocating motion of roller 35 in the direction of the arrow "B" relative to the first component 32. The eccentric assembly 46 includes an outer member 47 and a circular inner member 48 that is slidably/rotatably received within outer member 47. Inner member 48 is fixed to a shaft 49 at an off-center location, and shaft 49 is rotatably mounted to the support structure 31. As discussed in more detail below, shaft 49 is operably connected to an electric motor 53 or other powered actuator to provide powered rotation of shaft 49. An arm 50 is pivotably connected to the plate 36 at pivot 51, such that powered rotation of shaft 49 causes inner member 48 to rotate, resulting in linear reciprocating motion of forming roller 35 and plate 36 relative to the first component 32. It will be understood that other arrangements such as a crank arm or other powered mechanisms such as linear actuators may also be utilized to provide reciprocating motion of roller 35, and the illustrated eccentric is but one example of a suitable mechanism.

Figure 3A:
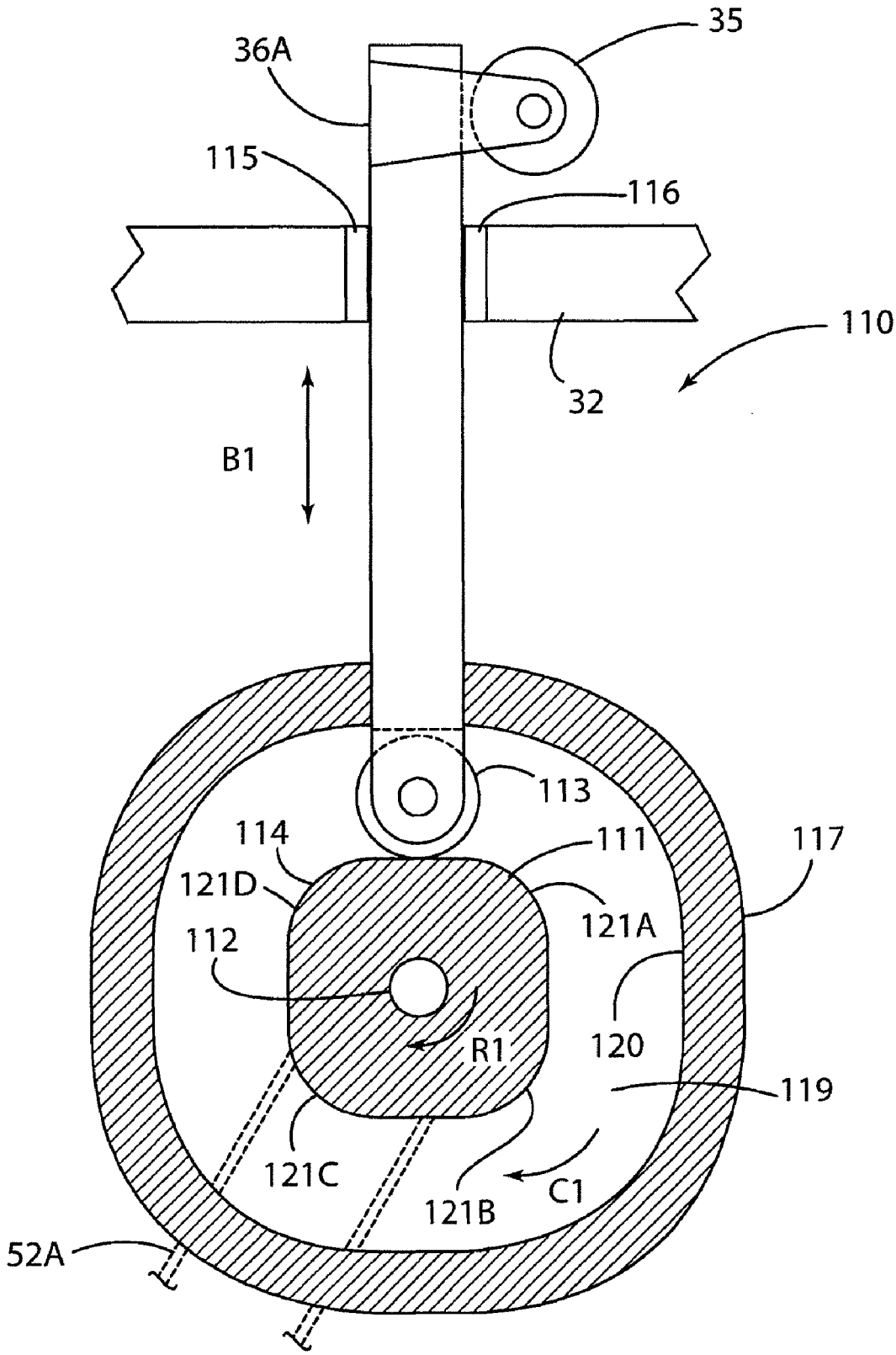
FIG. 3A is a partially schematic cross-sectional view of an oscillating mechanism according to another aspect of the present invention.

With further reference to FIG. 3A, an oscillating mechanism 110 according to another aspect of the present invention may be utilized instead of the eccentric assembly 46. The oscillating assembly 110 provides for more complex back and forth motion of plate 36A and roller 35 if required for a particular application. Oscillating assembly 110 includes an inner cam member 111 and outer cam member 117, both of which are mounted to a shaft 112 for rotation as indicated by the arrow "R1". A rotatable follower 113 is positioned in a space or channel 119 between inner cam member 111 and outer cam member 117 to provide reciprocating motion of plate 36A and roller 35 as shown by arrow "B1" upon rotation of cam members 111 and 117. Plate 36A is slidably supported on first component 32 by a pair of bearing plates 115 and 116 or other suitable linear bearing arrangement such that plate 36A and roller 35 can only move in a linear reciprocating manner. In the illustrated example, shaft 112 is rotatably mounted to support structure 31. Thus, channel 119 is shaped to account for movement of first component 32 relative to support structure 31. It will be understood that various linear bearings or the like could be utilized to support plate 36A for linear movement relative to first component 32. Also, plate 36A is shown as being a one-piece member, with roller 35 and follower 113 being mounted to plate 36A. Plate 36A could comprise an elongated arm that is similar to arm 50 (FIG. 3), and plate 36A could be rigidly or pivotably connected to the arm.

A space or channel 119 is defined between inner surface 120 of outer cam member 117 and outer surface 114 of cam 111, such that follower 113 is constrained, and follows a path "C1". The inner cam member 111 and outer cam member 117 may comprise a single piece of steel or other suitable material, and the space or channel 119 may comprise a machined channel in the single piece of material. In general, the width of the space or channel 119 is slightly greater than the diameter of the follower 113, such that the follower 113 is free to rotate upon contact with either the outer surface 114 of cam 111, or inner surface 120 of outer cam member 117. Because the follower 113 is constrained by the cams 111 and 117, the cam surfaces 114 and 120 can be relatively complex to provide for complex reciprocating motion. In this way, the oscillating mechanism 110 can provide for relatively complex motion of roller 35. Electric motor 53 or other powered actuator may be operably connected to the cams 111 and 117 by a belt or chain 52A, gears, shafts, or other suitable mechanism to provide for powered rotation of the cams 111 and 117. In the illustrated example, cam member 111 has four lobes 121A, 121B, 121C, and 121D. In general, if the cam members 111 and 117 rotate at the same rate as second cam 56, cam member 111 will have the same number of lobes 121 as lobes 61 of second cam 56. Each lobe 121 may have a unique shape if required to provide proper movement of roller 35. Cam members 11 and 117 may alternately be driven at a different rotational rate than second cam 56. For example, if cam members 111 and 117 are driven at twice the rotational rate of second cam 56, cam member 111 may have one-half the number of lobes 121 as second cam 56. Thus, the oscillating mechanism 110 in combination with the cam lobes 61 provide for complex motions of roller 35 to form a variety of paths for roller 35 as described in more detail below.

A second component 42 is pivotably mounted to the support structure 31 at a pin or shaft 43. A follower or roller 59 is mounted to second component 42, and follower 59 engages a first cam 54 such that rotation of first cam 54 causes second component 42 to pivot about shaft 43 relative to support structure 31. A tube 38 to be formed/notched and held in place in machine 30 by first and second clamp members 39 and 40. In the illustrated example clamp member 40 is fixed to structure 31, and clamp member 39 is fixed to second component 42 such that clamp member 39 moves relative to clamp member 40 upon rotation of first cam 54. First cam 54 is configured to tightly clamp tube 38 except for during a relatively small portion of the rotation of first cam 54. Various types of tube clamping/holding arrangements have been developed, and it will be understood that the clamp members 39 and 40 could be configured in a variety of different ways. As discussed in more detail below, first cam 54 and a second cam 56 are both fixed to a shaft 57 and rotate at the same angular rate during operation. Second cam 56 engages a follower or roller 66 on first member 32, and causes first member 32 to pivot about shaft 33 to thereby move roller 35 towards and away from tube 38, and first cam 54 clamps tube 38 during the forming process. First cam 54 includes a lobe 54A that causes tube 38 to be clamped during forming by roller 35, and a recessed region 54B that causes tube 38 to be unclamped during a few degrees of rotation at the start and the end of the forming process to permit removal of a formed tube 38, followed by placement of an unformed tube 38 in machine 30. In the illustrated example, the tube 38 is clamped during about 260° of a 360° cycle, and is unclamped for about 100° of the 360° cycle. Clamp members 39 and 40 include cylindrical surfaces that clamp tightly about tube 38. Alternately, a collet-type clamp (not shown) could also be utilized to clamp tube 38 in place during forming operations. Clamps 39 and 40 are substantially similar to known clamps utilized to secure tubes during forming operations, and the details of the clamp will therefore not be described in detail.

The second cam 56 includes a plurality of lobes 61A-61F, such that each rotation of second cam 56 causes multiple rotating movements of first component 32 about shaft 33. In general, the eccentric assembly 46 reciprocates the plate 36 and forming roller 35 multiple times for each revolution of second cam 56. Eccentric assembly 46 and cams 54 and 56 may be interconnected by a mechanical drive system such as a timing chain 52 that is connected to a fixed sprocket 84 on shaft 49 and a second sprocket 85 mounted to shaft 57. A third sprocket 86 is mounted to the rotating output shaft 88 of an electric motor 53, and a fourth sprocket 87 is mounted to shaft 57. A drive member/timing chain 55 wraps around third sprocket 86 and fourth sprocket 87, such that actuation of the electric motor 53 causes simultaneous reciprocating motion of plate 36 (and roller 35) and rotation of cams 54 and 56. It will be understood that various gears, drive shafts, or other mechanical drive components may be utilized to operably interconnect the electric motor 53 with the various moving components. Also, although use of a single electric motor 53 or other powered actuator ensures that the various components move relative to one another at the correct velocity and relative position, multiple electric motors or other suitable powered actuators may be utilized.

Electric motor 53 may be operably connected to a controller 58 that may be programmed to operate the machine 30 utilizing a user input 60. Controller 58 may provide, for example, adjustment of the r.p.m. of electric motor 53 as required for a particular application. Electronic motor 53 may rotate at a constant r.p.m. that is adjusted for a particular application, or the r.p.m. may be varied during each cycle if required. User input 60 may comprise one or more switches or buttons providing user input/control, and it may also include a display screen and/or indicator lights providing information to the user concerning the operation of machine 30. The lights (or screen) may indicate, for example, if a part 38 is present in the clamp, the rpm of electric motor 53, and/or the position of one or more moving components. User input 60 may be on controller 58 (e.g. on a housing controller 58), or it may comprise a separate unit such as a laptop computer that is operably connected to controller 58. The machine or device 30 may include one or more sensors (not shown) that are operably connected to controller 58 to provide for controlled operation of the machine 30. For example, one or more sensors (not shown) may be utilized to determine if a part 38 is present in clamp 39, and one or more additional sensors (also not shown) may be utilized to determine the position and/or velocity of one or more of the movable components. Controller 58 may be configured to stop electric motor 53 if part 38 is not properly positioned in clamp 39 during the portions of a cycle when a part 38 would normally be clamped in place if the machine is operating properly. The mechanical drive system ensures that the reciprocating motion of plate 36 and rotation of cams 54 and 56 are properly synchronized relative to one another. It will be understood that other powered drive arrangements such as servo motors and the like could also be utilized. Also, hydraulic or pneumatic actuators could be utilized to provide for powered operation of the various components.

In the illustrated example, second cam 56 includes six lobes 61A-61F, and eccentric assembly 46 shifts plate 36 and roller 35 such that roller 35 moves across tube 38 six times for each revolution of second cam 56. Each cam lobe 61A-61F has a unique shape to provide for incremental forming of tube 38 upon each pass of roller 35 across tube 38. In general, if second cam 56 rotates in a counter clockwise direction (FIG. 3), roller 35 will move towards tube 38 as follower 66 moves along a first surface portion 62A of lobe 61A, and roller 35 will momentarily change direction of movement as follower 66 moves across peak 63A of lobe 61A. Roller 35 will then move away from tube 38 as follower 66 moves along second surface portion 64A of lobe 61A. Roller 35 will move in a somewhat similar manner as follower 66 moves along surfaces 62B-62F, peaks 63B-63F, and surfaces 64B-64F of lobes 61B-61F, respectively. However, as discussed in more detail below, each lobe 61A-61F may have a unique shape that is configured to provide a specific movement of roller 35 as required to form tube 38 during each pass of roller 35 across tube 38. First cam 54 is configured to clamp tube 38 when it is being formed by roller 35, and to unclamp/release tube 38 after the last forming pass of roller 35 corresponding to lobe 61F. As follower 66 contacts surface portion 65 of second cam 56 between lobes 61A and 61F (i.e. after the last forming pass of roller 35 is completed), follower 59 contacts a surface portion 54B of first cam 54 that unclamps tube 38 to permit removal of a fully-formed tube 38, followed by insertion of an unformed tube 38. Although the lobes 61A-61F of cam 64 are shown as being spaced at equal angular increments, it will be understood that the spacing between lobes 61A and 61F could be increased relative to the spacing between the other lobes to provide for an increased time period/angular rotation of cams 54 and 56 during which tube 38 is unclamped to facilitate removal and insertion of tubes 38.

Figure 4:
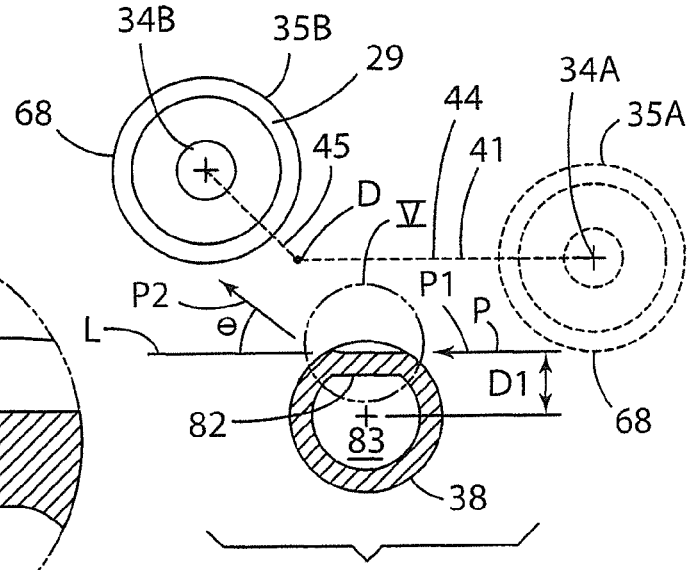
FIG. 4 is a partially schematic view illustrating the path of a roller during a first pass of the forming process.

With further reference to FIG. 4, in the illustrated example, roller 35 is initially at a position 35A and the outer edge surface 68 of roller 35 travels along a path "P" during a first forming pass as the roller 35 moves from the starting position 35A to the end position 35B relative to part 38. The roller 35 initially travels along a substantially linear path segment P1, then changes direction at point "D" to travel along a path segment P2. In the illustrated example, the path segment P2 forms an angle θ that is about 35 degrees relative to a line "L" extending through path segment P1. However, angle θ may be in the range of about 30-40 degrees, or it may be as small as 5 degrees, 10 degrees, or 20 degrees, or it may be as large as 50 degrees, 60 degrees or even 90 degrees. In general, angle θ may comprise an angle between 0 degrees and 180 degrees. Also, as described in more detail below, path segments P1 and P2 may be partially or completely curved or nonlinear. The movement of roller 35 illustrated in FIG. 4 is a result of the combined effects of the linear movement of plate 36 relative to first component 32, and the rotational movement of component 32 about shaft 33 as follower 66 moves along cam lobe 61A.

In the illustrated example, an axis of rotation 34 of roller 35 travels along a line or path 41 having first segment 44 and a second segment 45 between a first position 34A and a second position 34B. In the illustrated example, the path of the roller 35 changes directions at a point "D". The point D is chosen such that a significant portion of the partial groove 70 includes a linear or straight surface 71, and a relatively small radiused or angled end portion 72 is formed as the roller 35 changes directions at the point D. The point at which the change in direction occurs (i.e. position of point D) may be varied as required for a particular application, depending upon the material from which tube or other part 38 is formed, the diameter of the tube 38, and the wall thickness "T" of the tube 38. Also, although the path 44 is shown as having straight segments 41 and 45 that intersect at point D, it will be understood that the segments 41 and 45 may be joined by a smooth radius, rather than a "sharp" corner represented by the point D. For example, the segments 41 and 45 may be joined by a curved path segment having a radius of about 0.375 inches at point D. Also, the segments 41 and 45 of path 44 could be curved, and these path segments need not be straight or linear as illustrated in FIG. 4.

Figure 5:
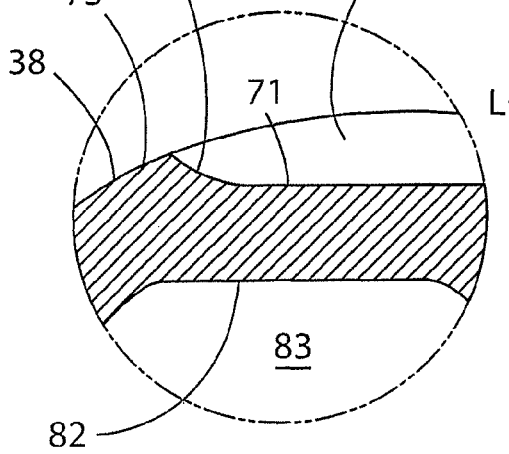
FIG. 5 is an enlarged view of a portion of FIG. 4.

With further reference to FIG. 5, the roller 35 initially forms a partial notch or groove 70 having a base surface portion 71 that is substantially linear. However, because the roller 35 changes directions, an end portion 72 of partial groove 70 is curved upwardly adjacent outer surface 73 of tube 38. If roller 35 were to continue along a straight path, some of the material forming tube 38 would be pushed outwardly, thereby forming a bulge in the outer surface 73 of tube 38 in the vicinity of the partial groove 70. However, because the direction of roller 35 changes to provide a component of motion that is away from tube 38, the formation of such bulges and the like is substantially reduced or eliminated. As roller 35 forms groove 70, some of the material of tube 38 is deformed inwardly at 82 into cavity 83 of tube 38.

Figure 7:
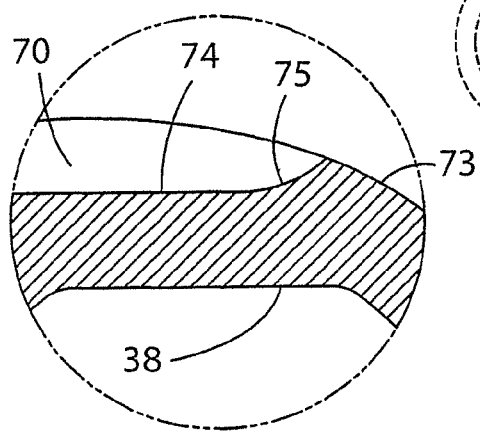
FIG. 7 is an enlarged view of a portion of FIG. 6.
Figure 6:
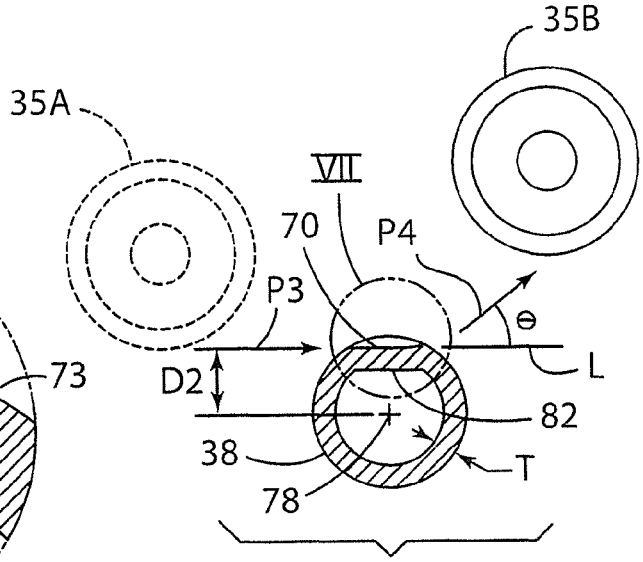
FIG. 6 is a partially schematic view illustrating the path of a roller during a second pass of the forming process.
Figure 9:
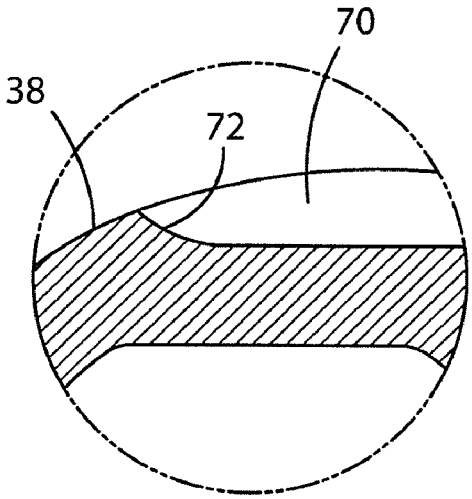
FIG. 9 is an enlarged view of a portion of FIG. 8.
Figure 8:
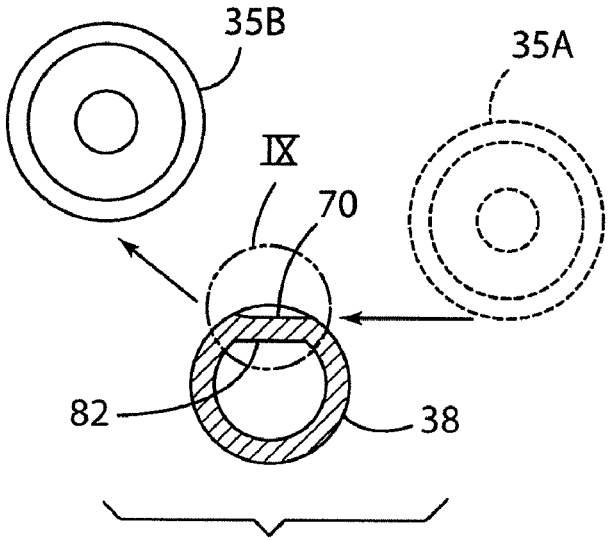
FIG. 8 is a partially schematic view illustrating the path of a roller during a third pass of the forming process.
Figure 11:
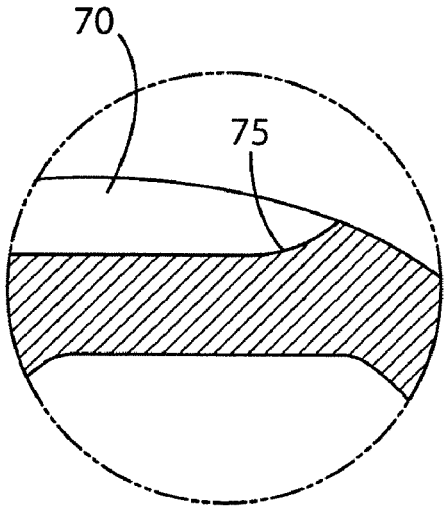
FIG. 11 is an enlarged view of a portion of FIG. 10.
Figure 10:
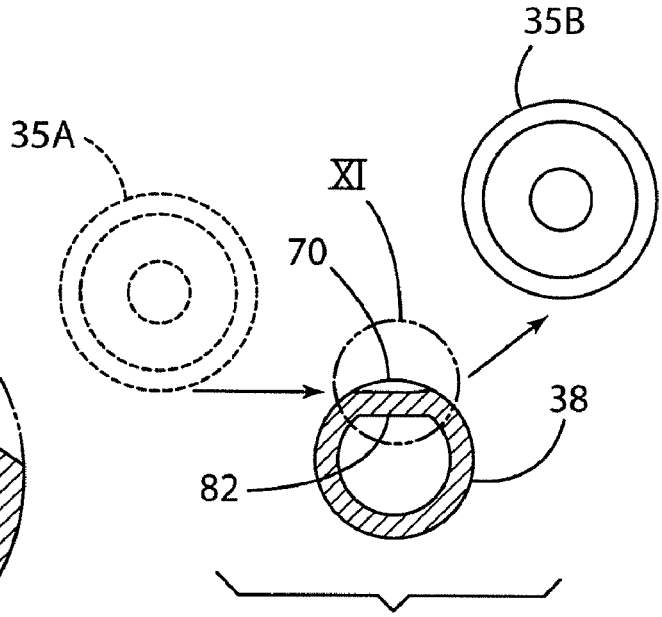
FIG. 10 is a partially schematic view illustrating the path of a roller during a fourth pass of the forming process.

With further reference to FIGS. 6 and 7, after a first pass (FIG. 4) of roller 35, roller 35 moves from position 35B (FIG. 4) to the position 35A (FIG. 6) due to motion of plate 36 and rotation of component 32 due to second cam 56. Roller 35 then moves back across the tube 38 in a second pass along a path having first and second segments P3 and P4 forming an angle θ. It will be understood that the angle θ may change. This motion results from linear motion of plate 36, relative to first component 32 and rotational movement of component 32 as follower 66 contacts second lobe 61B. Lobe 61B is configured to move roller 35 towards tube 38 for the first portion of the second pass corresponding to segment P3, such that the distance "D2" (FIG. 6) between the edge 68 of roller 35 and a center axis 78 of tube 38 is less than distance "D1" (FIG. 4) during the first pass of roller 35. After the second pass of roller 35 (FIG. 6), the partial groove 70 becomes deeper with a base surface portion 74 that is substantially linear, and an end portion 75 that extends upwardly. As discussed above in connection with FIGS. 4 and 5, the change in direction of the roller of 35 reduces or eliminates the formation of a bulge in outer surface 37 of tube 38 in vicinity of the partial groove 70. The second pass of roller 35 also eliminates the non-linear end portion 72 (FIG. 5) of groove 70.

In the illustrated example, the tube 38 has a wall thickness "T" of about 0.08 inches, and a diameter of about 0.50 inches. However, tube 38 may have different diameters (e.g. one inch) and wall thicknesses depending upon the requirements for a particular application. Also, in the illustrated example, the tube 38 is made of a high-tensile steel material. In this example, once the first pass of roller 35 (FIGS. 4 and 5) is completed, the roller 35 is shifted a distance (D1-D2) about 0.010 inches closer to the tube 38 for the second forming pass illustrated in FIGS. 6 and 7. However, the incremental shift of roller 35 closer to tube 38 may vary depending upon the thickness of the wall of the tubing 38, the material from which the tube 38 is made, and other variables. Also, the distance roller 35 is shifted may vary from one pass to the next for a given tube. As illustrated in FIGS. 8-11, the roller 35 is moved back and forth across the tube 38, and the roller 35 is moved closer to the tube 38 for each successive pass of the forming roller 35. In the illustrated example, the movement of roller 35 in FIGS. 8 and 10 corresponds to lobes 61C and 61D, respectively (FIG. 3) of second cam 56. In general, the number of passes will vary depending upon the size and shape of the notch being formed, the material, size, and shape of part 38, and other process variables. The number, size, shape, and positions of cam lobes of second cam 56 may be changed as required to provide the proper number of passes, path direction, etc. for a particular application.

Figure 12:
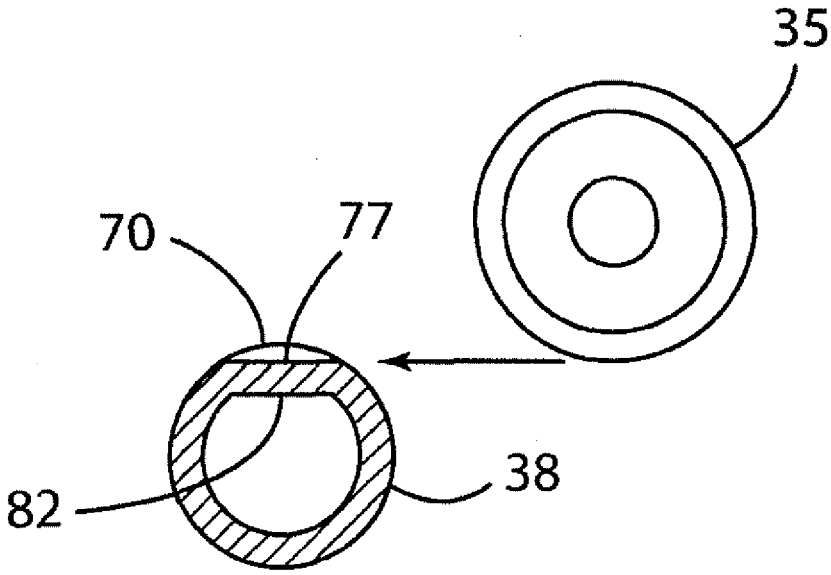
FIG. 12 is a partially schematic view showing the motion of a roller during a finishing pass just prior to the end of the forming process.
Figure 13:
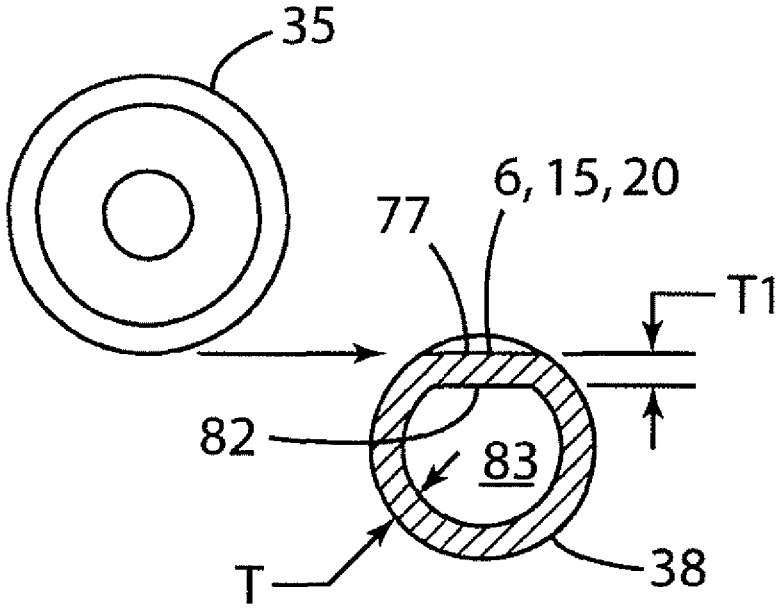
FIG. 13 is a partially schematic view showing the motion of a roller during a final pass at the end of the forming process.

With further reference to FIGS. 12 and 13, after the partial groove 70 has been formed to a depth that is equal to, or close to, the final depth of the notch, the roller 35 is moved across the tube 38 in a substantially straight path to flatten the end portion 72 (FIG. 5) and end portion 75 (FIG. 7) to thereby form a linear or straight bottom surface 77. The linear motion of roller 35 illustrated in FIGS. 12 and 13 corresponds to lobes 61E and 61F, respectively of second cam 56 (FIG. 3). In this way, a groove having a profile as illustrated by the notches 6, 15, and 20 (FIG. 2) can be formed. It will be understood that the roller 35 has a surface contour adjacent the outer edge surface 60A of roller 35 that is configured to provide the proper groove shape for a particular application.

Figure 14:
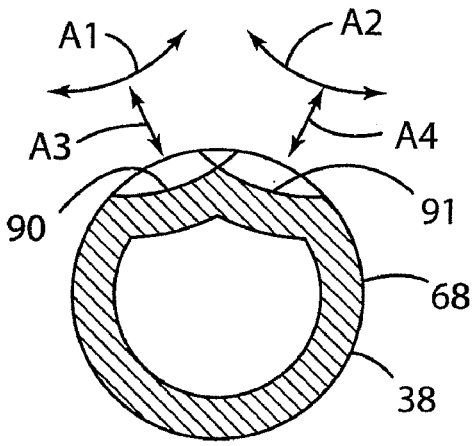
FIG. 14 is a partially schematic view showing alternate roller paths according to another aspect of the present invention.
Figure 15:
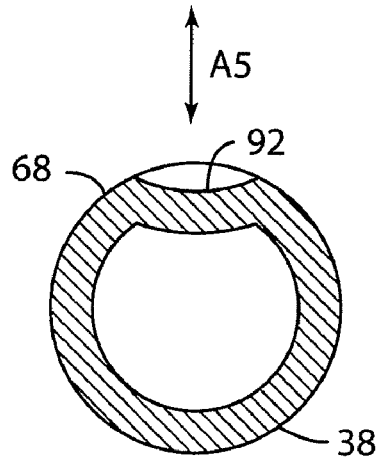
FIG. 15 is a partially schematic view showing another roller path.
Figure 16:
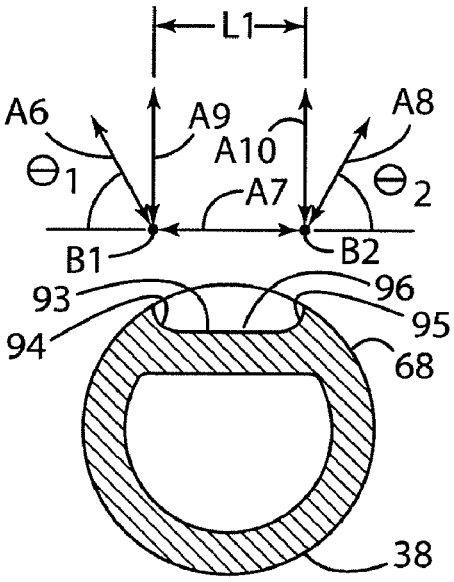
FIG. 16 is a partially schematic view showing alternate roller paths.
Figure 17:
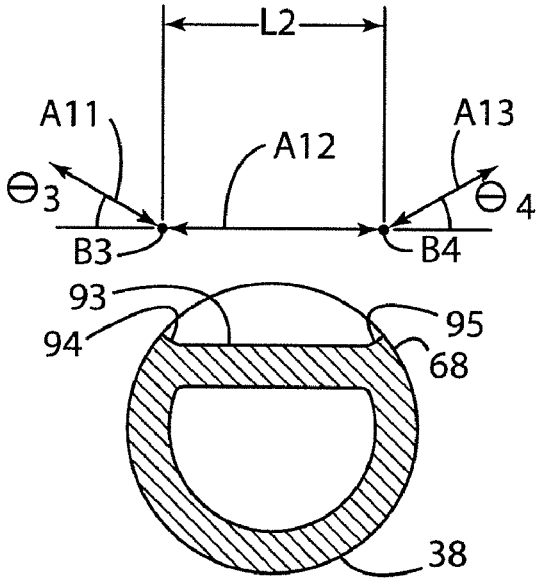
FIG. 17 is a partially schematic view showing alternate roller paths.

In addition to the forming paths discussed above in connection with FIGS. 4-13, the roller 35 may also be configured to travel along a plurality of paths as illustrated in FIGS. 14-17. FIGS. 14 and 15 show various roller motions or paths that may be utilized to perform the initial forming operations on a tube 38; FIG. 16 shows various forming paths that may be utilized for one or more intermediate passes; and FIG. 17 illustrates one or more paths for forming passes that may be utilized to finish the forming operation.

With reference to FIG. 14, one or more initial grooves or indentations 90 and/or 91 may be formed by moving roller 35 along a path indicated by the arrow "A1" or the path indicated by the arrow "A2", respectively. The paths A1 and A2 may be curved, or they may include substantially straight segments as shown in, for example, FIG. 4. Alternately, indentations 90 and/or 91 may be formed by movement of roller 35 as shown by the arrows "A3" and "A4", respectively. The roller 35 moves in a direction that is substantially perpendicular to the surface 68 of tube 38 when moving along the paths shown by the arrows A3 and A4. A single initial indentation 92 may also be formed by moving roller 35 in the direction of the arrow "A5", which is substantially perpendicular to the outer surface 68 of tube 38.

With further reference to FIG. 16, after forming initial indentations 90 and/or 91 or 92, one or more forming passes may be utilized to form an enlarged indentation or groove 93 having non-linear end portions 94 and 95. Roller 35 may travel along a path shown by the arrow "A6", followed by movement as shown by the arrow "A7", followed by movement shown by the arrow "A8". The roller 35 may travel in either direction along the path segments shown by the arrows A6, A7, and A8, such that each pass is generally U-shaped. The path segment A6 forms an angle $\theta_1$ relative to path segment A7, and path segment A8 forms an angle $\theta_2$ relative to path segment A7. The angles $\theta_1$ and $\theta_2$ may be about 90° or a few degrees less than 90°. In general, angles $\theta_1$ and $\theta_2$ may be in a range of about 70° to about 90°, and the angles $\theta_1$ and $\theta_2$ are preferably about 80° according to one aspect of the present invention. Alternately, the angles $\theta_1$ and $\theta_2$ may be about 90°, such that the roller 35 travels along the path segments A7, A9, and A10. The center path segment A7 has a length "L1". The length L1 may increase during successive passes to thereby successively increase the length of the base 96 of groove 93. The angle $\theta_1$ may be equal to the angle $\theta_2$, such that the path of the roller 35 is symmetrical. However, the angle $\theta_1$ does not need to be equal to the angle $\theta_2$, and the path traveled by the roller 35 may therefore be asymmetrical. Also, the path is shown as abruptly changing direction at the points "B1" and "B2". However, the path may include a curved transition between straight path portions A6, A7, and A8 (or path sections A7, A9 and A10). Alternately, the path sections may all be curved, such that the roller travels along a curved path that is somewhat similar to the paths "A1" and "A2" of FIG. 14.

With further reference to FIG. 17, after the roller 35 travels along one or more paths as illustrated in FIG. 16, one or more finishing passes may be made to reduce or eliminate the non-linear end portions 94 and 95 of the partially-formed groove. The roller may travel along a path defined by the segments "A11", "A12", and "A13". The angles $\theta_3$ and $\theta_4$ for the finishing passes shown in FIG. 17 are typically substantially smaller than the angles $\theta_1$ and $\theta_2$ of the intermediate forming passes shown in FIG. 16. The angles $\theta_3$ and $\theta_4$ for the finishing passes may be in a range of about 0° to about 30°, and more preferably are in a range of about 5° to about 10°. Length "L2" of the center path section A12 is typically somewhat longer than the dimension "L1" of the intermediate passes (FIG. 16). In the illustrated example, the dimension "L2" (FIG. 17) is the distance between the points "B3" and "B4" defining the intersection between the path sections A11 and A12, and A12 and A13, respectively. The path sections A11, A12 and A13 may be joined by a curved transition portion rather than the points B3 and B4, or the path sections A11, A12, and A13 may be curved to form paths that are somewhat similar to paths A1 and A2 (FIG. 14). However, in a preferred embodiment the path section A12 is straight to thereby form a straight indentation 93 along the base of the notch or groove. Also, the end portions 94 and 95 are quite small, and the dimension L2 is therefore typically almost as great as the distance of a line extending along the straight portion 93 of the groove where the line would intersect the outer surface 68 of the tube 38. The angles $\theta_3$ and $\theta_4$ may be reduced to zero for one or more final finishing passes to eliminate end portions 94 and 95 and thereby produce a notch having a linear vertex.

As discussed above, the reciprocating component of the motion of roller 35 results from the eccentric assembly 46 (FIG. 3), and the component of motion of roller 35 away from tube 38 is due to the rotation of first component 32 about shaft 33 due to second cam 56. The configuration of the eccentric 46 and the lobes 61-64 of second cam 56 are selected to provide the desired path of the roller 35 as shown in FIGS. 4, 6, 8, 10, 12, and 13. However, other mechanical devices, actuators, and the like could also be utilized to provide the desired path of movement of the roller 35. For example, pneumatic, hydraulic, electrical, or other powered actuators (not shown) could be operably connected to controller 58, and one or more sensors (also not shown) could be operably connected to controller 58 to provide controller 58 with information concerning the position and/or velocity of one or more movable components such as roller 35. Controller 58 may be programmed to provide the required motion of roller 35 along one or more paths during a series of forming passes as described above in connection with FIGS. 4-17.

In the illustrated example of FIGS. 4-13, six forming passes corresponding to lobes 61A-61F of second cam 56 are utilized to form the notches, and a notch is fully formed in a tube 38 for each revolution of second cam 56. However, it will be understood that a greater or fewer number of passes may be required for different notch shapes/sizes. For example, as few as two passes may be utilized to form tube 38, or ten or more passes may be utilized. If the forming passes of FIGS. 14-17 are utilized, a total of about 8-16 passes (and/or linear motions A3, A4, A5) are typically utilized. Also, a plurality of cams 56 having different numbers of lobes and/or sizes/shapes of lobes may be fabricated, and the machine 30 may be configured to form different notch shapes/sizes by changing second cam 56 to a cam having a different profile. Also, the roller(s) 35 may also be changed as required to provide for different notch shapes, and the clamp members 39 and 40 may also be changed to accommodate tubes of different sizes.

As discussed above, the path of the roller while it is in contact with the tube 38 may have a variety of shapes, and may include straight or curved portions. In general, the path of the roller is non-linear and includes a component of motion away from the part at or near the end of the contact with the part to reduce or eliminate bulging or other deformation adjacent the notch or groove. Prior to the finishing passes of the roller, the groove will typically have one or two end portions (e.g. end portions 94, 95, FIGS. 16 and 17) and a deeper center portion to thereby reduce bulging. Also, although the part 38 is moved in an arc about shaft 43 while roller 35 moves linearly in the illustrated example, it will be understood that other arrangements could be utilized to provide the proper relative motion of part 38. For example, either roller 35 or part 38 could be fixed/stationary relative to support structure 31, and the other of the roller 35 or part 38 could move along a nonlinear path to provide the desired relative motion of roller 35 relative to part 38.

During operation, the rotation of cams 54 and 56 may be stopped when follower 66 is adjacent surface portion 65 of second cam 56 (FIG. 3) to permit insertion/removal of tubes 38. Alternately, cams 54 and 56 may be rotated continuously without stopping to load/unload tubes 38. Also, a mechanical device (not shown) may be utilized to automatically load and unload tubes 38 without stopping the rotation of cams 54 and 56. Tubes 38 may be cut to length prior to loading tubes 38 into machine 30, or longer tube sections may be fed into machine 30, followed by cutting of the tube into shorter sections to form individual tubes.

If a plurality of grooves are to be formed on a tube, the device 30 may include a plurality of rollers 35 mounted on plate 36, such that a plurality of grooves are simultaneously formed in a tube 38. Alternately, the machine or device 30 may include a single roller 35, and the tube 38 may be unclamped and moved to a new location relative to the clamps 39 and 40 for forming of additional notches. Also, although the forming tool or member 35 preferably comprises a roller having a uniform circular shape, other forming members (e.g. non-rotatable forming members) may also be utilized to form the notches. It will be recognized that oil or other lubricants may be utilized in conjunction with rollers or other forming members if required for a particular application. Also, tube 38 may comprise a U-shaped part having a pair of generally parallel notched sections such as the supports 4 and 5 (FIG. 1), and a transverse section (not shown) extending between the parallel sections. Machine 30 may include a pair of rollers 35 operably connected to second cam 56 that simultaneously form notches in the parallel sections of the tube.

Also, machine 30 may include a plurality of rollers 35, each of which moves along the same path, with part 38 being moved to a new position following each pass such that the notch is successively formed by different rollers. For example, a first roller 35 may be configured to move along the path shown in FIG. 4, a second roller may be configured to move along the path shown in FIG. 6, a third roller may be configured to move along the path shown in FIG. 8, a fourth roller may be configured to move along the path shown in FIG. 10, a fifth roller may be configured to move along the path shown in FIG. 11, and a sixth roller may be configured to move along the path shown in FIG. 13, with the part 38 and/or rollers being shifted relative to one another between forming passes to align the partially-formed notch with the next roller in the sequence. If required, the rollers may have different sizes and/or shapes to provide forming of the notch in a controlled/required manner.

The forming machine or device 30 and method of the present invention provide a way to form notches in tubes in a manner that alleviates the drawbacks associated with prior forming techniques and machines. For example, because material is not removed to form the notches, the tube 13 is not weakened due to the substantially reduced wall thickness resulting from removal of material. Specifically, referring to FIG. 5, material 82 of tube 38 is deformed towards the central cavity 83 of tube 38 due to the action of roller 35. With further reference to FIG. 13, once the notches are fully formed, tube 38 has a wall thickness "T1" at the notch 6, 15, or 20. The thickness T1 is generally about the same as the wall thickness T of tube 38 away from the notches. Also, the forming roller 35 may be configured as such that the notches 6, 15, and 20 have substantially smooth outer surfaces. Still further, the forming process discussed in more detail above substantially eliminates the formation of burrs, bulges, or other visual imperfections in the vicinity of the notches.

With further reference to FIG. 18, two-way locking notch 15 includes opposing side surfaces 16 and 17, and a base or root surface 18. Corners 24 and 25 formed at the inner section of base surface 18 and sidewall surfaces 16 and 17, respectively, may be relatively sharp, or they may have a relatively large radius. The side wall surfaces 16 and 17 are preferably perpendicular to the outer surface 68 of the tubes 4 and 5, or the side wall surfaces 16 and 17 may taper inward towards each other slightly, such that the angle defined between the side wall surfaces 16 and 17 and the outer surface 68 of the tubes 4 and 5 may be in the range of 90°, or slightly greater than 90°. The inner section of the side wall surfaces 16 and 17 with the outer surface 68 of the tubes 4 and 5 form outer corners or edges 26 and 27, respectively. The present invention provides a way to form the two-way locking notch 15 such that the outer corners or edges 26 and 27 are quite sharp, with a very small radius. The ability to form relatively flat side wall surfaces 16 and 17 that are 90°, or close to 90° relative to the outer surface 68 of the tubes 4 and 5, along with the formation of sharp points or edges 26 and 27 provides for improved engagement of the device 7 (see also FIG. 2), thereby ensuring the headrest 3 and tubes 4 and 5 remain at the selected height when the device 7 engages two-way locking notch 15. Also, as discussed above, because material is not removed to form two-way locking notch 15, the side wall thickness "T" is substantially uniform in the region of the notch 15, such that the strength of the tubes 4 and 5 is not reduced to the same degree as is would be if material had been cut out or otherwise removed to form the two-way notch 15.

With further reference to FIG. 19, a one-way locking notch 20 includes a tapered or angled surface 22, and a first surface 21 that intersects with the surface 22 at a root or base 23. The surface 21 is perpendicular, or close to perpendicular to the outer surface 68 of tubes 4 and 5, and forms a sharp outer corner 28. As discussed above in connection with the two-way locking notch 15 of FIG. 18, this ensures that the device 7 engages one-way locking mesh 20 to prevent upward movement of the tubes 4 and 5. Also, as discussed above in connection with FIG. 18, the side wall thickness "T" is approximately constant throughout the area of the one-way locking notch 20, such that the strength of the tubes 4 and 5 is not reduced to the extent it would be if material were removed to form the one-way locking notch 20.

Figure 20:
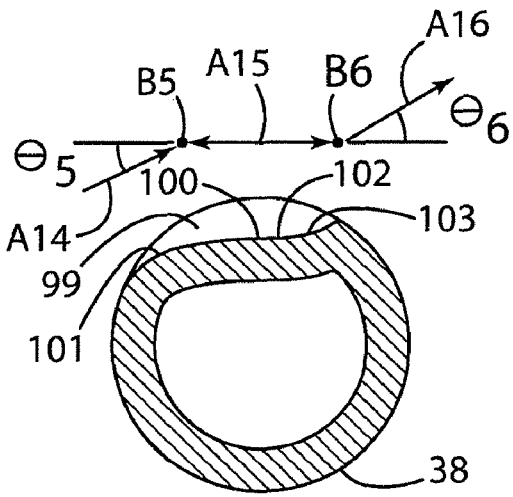
FIG. 20 is a cross sectional view showing an alternate roller path that may be utilized to form a groove having a vertex that is convex in cross section.

With further reference to FIG. 20, the lobes of second cam 56 may be configured such that roller 35 travels along a path defined by the arrows A14, A15, and A16. The arrow A14 forms an angle $\theta_5$ with the arrow A15, and the arrow 16 forms an angle $\theta_6$ relative to the arrow A15. Arrows A14 and A15 intersect at the point B5, and the arrows A15 and A16 intersect at the point B6. The angles $\theta_5$ and $\theta_6$ may be equal to one another, or they may be different. In general, the angles $\theta_5$ and $\theta_6$ are between about zero degrees and 90 degrees. In a preferred embodiment, the angle $\theta_5$ is smaller than angle $\theta_6$. For example, the angle $\theta_5$ may be less than 45 degrees in a range of about 10 degrees to about 30 degrees, and preferably about 20 degrees. The angle $\theta_6$ may be greater than 45 degrees, in a range of about 80 degrees to about 90 degrees. In general, the angle $\theta_6$ may be close to, but slightly less than 40 degrees. It will be understood that the path sections shown by the arrows A14, A15, and A16 may be curved, or they may be straight. The roller path illustrated in FIG. 20 forms a partial notch 99 having a base or vertex 100 having a first portion 101, a central portion 102, and an end portion 103. Because the path of the roller is asymmetrical, and somewhat S-shaped, the base or vertex 100 of the notch or groove 99 is non-linear, with a convex portion adjacent the first portion 101, and a concave portion adjacent the end portion 103.

Figure 21:
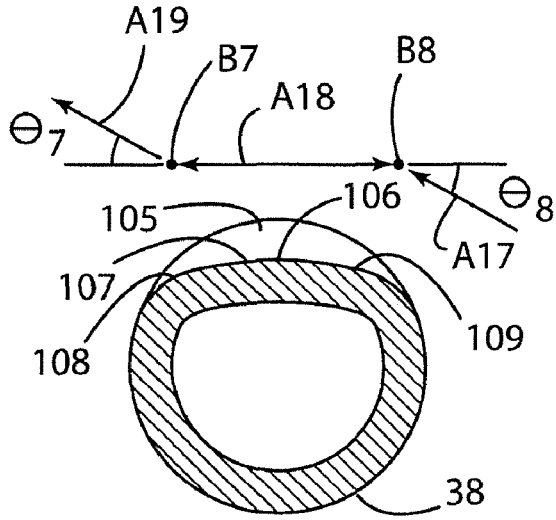
FIG. 21 is a cross sectional view showing an alternate roller path that may be utilized to form a groove having a vertex that is convex in cross section.

Referring to FIG. 21, a subsequent roller path may include sections shown by the arrows A17, A18, and A19. The path section shown by the arrow A17 forms an angle $\theta_8$ with the path section shown by the arrow A18, and the path section shown by the arrow A19 forms an angle $\theta_7$ with the path section shown by the arrow A18. The path sections A17 and A18 intersect at the point B8, and the path sections shown by the arrows A18 and A19 intersect at the point B7. The angle $\theta_8$ may be substantially similar to the magnitudes of the angle $\theta_5$ (FIG. 20) described above, and the magnitude of angle $\theta_7$ may be substantially similar to the angle $\theta_6$. A series of back-and-forth passes as shown in FIGS. 20 and 21 may be provided to form a notch 105 (FIG. 21) having a base or vertex 106 with a center portion 107 and first and second end portions 108 and 109. It will be understood that the roller 35 will typically be brought closer to the tube 38 for each successive path, and the shape of successive paths need not be identical. For example, the initial forming passes could have one of the shapes shown in FIGS. 4-17, and finishing passes as shown in FIGS. 20 and 21 could be utilized for form a convex notch as shown in FIG. 21. In general, the passes shown in FIGS. 20 and 21 produce a final notch shape having a base or vertex 106 having a convex, curved shape in cross-section as shown in FIG. 21.

Referring again to FIGS. 1 and 2, the notch 105 may comprise a V-shaped notch 6, a two-way locking notch 15, or it may comprise a one-way locking notch 20. Because the tube sections 4 and 5 may not be aligned precisely with the height-retaining members or devices 7A and 7B, if the notches 6, 15, and 20 have a straight or linear vertex, the devices 7A and 7B may not properly engage the notches. However, the convex notch shape 105 (FIG. 21) permits some misalignment of the tube sections 4 and 5 relative to the mechanisms 7A and 7B, while still providing for proper height adjustment of the headrest 3. For example, if one or both of the tube sections 4 and 5 are rotated somewhat about their respective centerlines "C", the convex notch shape 105 (FIG. 21) will still permit the devices 7A and 7B to securely engage the notches.

Although the tube 38 in the illustrated example is utilized to form tubular supports 4 and 5 (FIG. 1) for a headrest 3, the machine and method of the present invention may be utilized to form notches in tubes or solid bars for a variety of applications.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A method of forming a notch in an elongated tube, comprising:

providing an elongated tube defining an axis and an outer surface, wherein the elongated tube comprises a plastically-deformable material;

providing a machine having a forming member configured to move along a plurality of forming passes;

fixing the elongated tube in the machine;

forming a notch in the elongated tube by bringing the forming member into contact with the elongated tube utilizing a plurality of forming passes to plastically deform the outer surface inwardly, the forming member traveling along a nonlinear path relative to the elongated tube being formed during at least one of the forming passes, the nonlinear path being defined by movement of the forming member while the forming member is in contact with the elongated tube, the movement of the forming member including components of motion in a first direction relative to the elongated tube and components of motion in a second direction relative to the elongated tube, wherein the second direction is transverse to the first direction.

2. The method of claim 1, wherein:

the nonlinear path includes a first end portion defined by an initial contact between the forming member and the elongated tube, and an end portion defined by a loss of contact between the forming member and the elongated tube; and wherein:

the forming member moves away from the elongated tube at an increased rate due to the components of motion in the second direction at the end portion of the nonlinear path.

3. The method of claim 2, wherein:

the forming member initially moves linearly upon contact with the elongated tube.

4. The method of claim 2, wherein:

the first and second directions are orthogonal to each other, and the forming member comprises a roller that initially moves linearly in the first direction upon contact with the elongated tube, followed by linear motion in a third direction that defines a non zero angle relative to the first direction.

5. The method of claim 4, wherein:

the non zero angle comprises an acute angle that is in the range of about 0 degrees to about 90 degrees.

6. The method of claim 5, wherein:

the acute angle is in the range of about 70 degrees to about 90 degrees.

7. The method of claim 6, wherein:

the acute angle is about 90 degrees.

8. The method of claim 4, wherein:

the roller moves in a non-linear manner to transition from movement in the first direction to movement in the third direction.

9. The method of claim 8, wherein:

movement of the roller defines a curved path portion.

10. A method of forming a notch in a part, comprising:

providing a part defining an outer surface, wherein the part comprises a plastically-deformable material;

providing a machine having a forming member that comprises a roller, wherein the forming member is configured to move along a plurality of forming passes;

fixing the part in the machine;

forming a notch in the part by bringing the forming member into contact with the part utilizing a plurality of forming passes to plastically deform the outer surface inwardly, the forming member traveling along a nonlinear path relative to the part being formed during at least one of the forming passes, the nonlinear path being defined by movement of the forming member while the forming member is in contact with the part, the movement of the forming member including components of motion in a first direction relative to the part and components of motion in a second direction relative to the part, wherein the second direction is transverse to the first direction;

forming the notch includes forming a groove that is enlarged by successive forming passes to form a notch; and including:

moving the roller along a nonlinear path to form a groove having sidewalls that converge to define an apex, the apex having a nonlinear shape due to the nonlinear motion of the roller.

11. The method of claim 10, wherein:

the roller includes a peripheral edge surface having a V-shape in cross-section; and the sidewalls of the groove include generally planar portions corresponding to the cross-sectional shape of the peripheral edge surface of the roller.

12. The method of claim 10, wherein:

the apex of the groove includes a generally linear first portion, and a curved second portion adjacent an outer surface of the part.

13. The method of claim 10, wherein:

the part comprises a tube having generally cylindrical inner and outer surfaces prior to forming; and:

a portion of the inner surface is deformed inwardly as the forming member contacts the outer surface of the tube.

14. The method of claim 10, wherein:

the first and second directions are orthogonal relative to each other;

the roller moves along first and second nonlinear paths during a pair of sequential forming passes;

the roller is initially moved in the first direction upon contact with the elongated tube during a first of the pair of sequential forming passes, followed by movement in a third direction that defines an acute angle relative to the first direction; and:

the roller is initially moved in a fourth direction that is opposite the first direction upon contact with an elongated tube during a second of the pair of sequential forming passes, followed by movement in a fifth direction that defines an acute angle relative to the fourth direction.

15. The method of claim 14, wherein:

the roller is moved to provide a decreasing depth of the groove adjacent an outer surface of the part relative to a depth the groove would have if the roller traveled along a linear path relative to the part.

16. The method of claim 14, wherein:

the first of the pair of sequential forming passes comprises a first forming pass deforming the part.

17. The method of claim 14, wherein:

the roller is moved along a substantially linear path in a forming pass occurring after the second of the pair of sequential forming passes.

18. The method of claim 17, wherein:

the roller is moved in a first direction along the linear path, the linear path comprising a first linear path; and:

the roller is moved along a substantially linear second path in a direction opposite the first direction during a subsequent forming pass.

19. A method of forming a notch in a part, comprising:

providing a tube defining an axis and an outer surface, wherein the tube comprises a plastically-deformable material;

providing a machine having a forming member configured to move along a plurality of forming passes;

fixing the tube in the machine;

forming a notch in the tube by bringing the forming member into contact with the tube utilizing a plurality of forming passes to plastically deform the outer surface inwardly, the forming member traveling along a generally S-shaped nonlinear path relative to the tube being formed during at least one of the forming passes, the nonlinear path being defined by movement of the forming member while the forming member is in contact with the part, the movement of the forming member including components of motion in a first direction relative to the tube and components of motion in a second direction relative to the tube wherein the second direction is transverse to the first direction;

wherein the method includes forming the notch utilizing a series of back and forth S-shaped forming passes of the forming member; and wherein the notch includes a vertex having a convex shape in a cross-section taken perpendicular to the axis of the tube.

20. A method of forming a notch in an elongated member, the method comprising:

providing an elongated member defining an axis and comprising a plastically-deformable material having an outer surface;

moving a forming member into contact with the outer surface of the elongated member transverse to the axis of the elongated member such that the outer surface is deformed inwardly to form a groove without removing material from the elongated member, and wherein the forming member is moved in a first direction relative to the elongated member while the forming member is in contact with the elongated member, followed by movement in a second direction relative to the elongated member while the forming member is in contact with the elongated member, wherein the second direction includes components that are in a direction that is transverse to the first direction and away from the deformed portion of the outer surface of the elongated member.

21. The method of claim 20, wherein:

the forming member comprises a roller, and moving the forming member includes rotating the roller.

22. The method of claim 20, wherein:

the forming member is initially moved linearly in the first direction upon contact with the outer surface of the elongated member.

23. The method of claim 22, wherein:

the first and second directions are orthogonal relative to each other; and the forming member is moved linearly in a third direction while it is in contact with the part after initially moving linearly in the first direction, wherein the third direction defines an acute angle relative to the first direction.

24. A method of forming a notch in a part, the method comprising:

providing a part comprising a plastically-deformable material having an outer surface;

moving a forming member into contact with the outer surface of the part such that the outer surface is deformed inwardly to form a groove without removing material from the part, and wherein the forming member is moved in a first direction relative to the part while the forming member is in contact with the part, followed by movement in a second direction relative to the part while the forming member is in contact with the part, wherein the second direction includes components that are in a direction that is transverse to the first direction;

the forming member is initially moved linearly in the first direction upon contact with the outer surface of the part;

the part comprises a metal tube; and movement of the forming member in the first direction is followed by movement of the forming member along a nonlinear path while it is in contact with the metal tube.

25. A method of forming a notch in a part, the method comprising:

providing a part comprising a plastically-deformable material having an outer surface;

moving a forming member into contact with the outer surface of the part such that the outer surface is deformed inwardly to form a groove without removing material from the part, and wherein the forming member is moved in a first direction relative to the part while the forming member is in contact with the part, followed by movement in a second direction relative to the part while the forming member is in contact with the part, wherein the second direction includes components that are in a direction that is transverse to the first direction;

the forming member is moved along a series of S-shaped passes such that the notch has a vertex that is convex.

26. A machine for forming notches in parts, the machine comprising:

a support structure;

a holder connected to the support structure, the holder configured to securely support a part during forming operations;

a powered actuator connected to the support structure;

a forming member that is operably connected to the powered actuator such that the powered actuator moves the forming member in a plurality of back and forth passes that are non-linear while the forming member is in contact with a deformable surface portion of a part that is being formed by the forming member, and wherein the forming member contacts the deformable surface portion on subsequent passes to further deform the deformable surface portion of the part.

27. The machine of claim 26, wherein:

the forming member comprises a roller that is operably connected to the powered actuator for movement in a reciprocating manner.

28. The machine of claim 27, wherein:

the holder is mounted on a rigid member that is pivotably connected to the support structure.

29. The machine of claim 26, including:

a controller operably connected to the powered actuator for control thereof.

30. A machine for forming notches in parts, the machine comprising:

a support structure;

a holder connected to the support structure, the holder configured to securely support a part during forming operations;

a powered actuator connected to the support structure;

a forming member that is operably connected to the powered actuator such that the powered actuator moves the forming member in a non-linear manner while it is in contact with a part that is being formed by the forming member;

a multi-lobed cam having a plurality of lobes that engage a cam follower on the rigid member and causing the rigid member to pivot upon rotation of the multi-lobed cam such that the holder moves relative to the roller.

31. The machine of claim 30, wherein:

the holder comprises a clamp having first and second clamp members that open and close to selectively retain a part; and including:

a clamp cam operably connected to the clamp and opening and closing the first and second clamp members upon rotation of the clamp cam.

32. The machine of claim 31, wherein:

the powered actuator comprises an electric motor having a rotating output member;

the roller is connected to the support structure by a linear guide; and including:

a crank arm operably interconnecting the roller to the electric motor such that the roller moves in a linear reciprocating manner upon rotation of the rotating output member of the electric motor.

33. The machine of claim 32, wherein:

the multi-lobed cam is operably connected to the rotating output member of the electric motor such that the multi-lobed cam rotates upon rotation of the rotating output member of the electric motor.

34. The machine of claim 33, wherein:

the lobes of the multi-lobed cam are shaped to provide a series of forming passes that progressively deform the metal tube.

35. The machine of claim 34, wherein:

a first cam lobe provides a non-linear forming pass, such that a second cam lobe provides a linear forming pass.

36. The machine of claim 35, wherein:

the multi-lobed cam includes a plurality of lobes providing non-linear forming passes formed by at least two substantially linear forming passes.

* * * * *